US008500000B2

(12) United States Patent
Berendes

(10) Patent No.: US 8,500,000 B2
(45) Date of Patent: Aug. 6, 2013

(54) DEVICE FOR LOCKING AND UNLOCKING THE JALOUSIE OF A CONTAINER

(75) Inventor: Elmar Berendes, Warburg-Nörde (DE)

(73) Assignee: Wincor Nixdorf International GmbH (DE)

( * ) Notice: Subject to any disclaimer, the term of this patent is extended or adjusted under 35 U.S.C. 154(b) by 158 days.

(21) Appl. No.: 13/060,620

(22) PCT Filed: Aug. 17, 2009

(86) PCT No.: PCT/EP2009/060613

§ 371 (c)(1),
(2), (4) Date: Feb. 24, 2011

(87) PCT Pub. No.: WO2010/023126

PCT Pub. Date: Mar. 4, 2010

(65) Prior Publication Data

US 2011/0155736 A1 Jun. 30, 2011

(30) Foreign Application Priority Data

Aug. 28, 2008 (DE) ..... 10 2008 044 838

(51) Int. Cl.
*G07B 15/00* (2006.01)

(52) U.S. Cl.
USPC ..... 232/15; 232/1 D; 232/44; 194/350; 109/64

(58) Field of Classification Search
USPC ..... 232/1 D, 15, 16, 44, 43.2; 194/350, 194/351; 109/52, 64, 66, 73; 206/807; 220/324, 345.2, 350; 271/162; 221/154; 235/379
See application file for complete search history.

(56) References Cited

U.S. PATENT DOCUMENTS 4,235,433 A * 11/1980 Hirata ..... 271/162
4,552,075 A * 11/1985 Glasson et al. ..... 109/52

(Continued)

FOREIGN PATENT DOCUMENTS

| | | | |
|---|---|---|---|
| DE | 28 00 707 | A1 | 8/1979 |
| DE | 690 04 906 | T2 | 7/1994 |
| EP | 01 538 46 | A2 | 9/1985 |
| EP | 0 168 591 | A2 | 1/1986 |
| EP | 02 63 680 | A1 | 4/1988 |

(Continued)

OTHER PUBLICATIONS

Notification of Transmittal of Copies of Translation of the International Preliminary Report on Patentability for PCT/EP2009/060613 (Mar. 10, 2011).

*Primary Examiner* — William L. Miller
(74) *Attorney, Agent, or Firm* — Harness, Dickey & Pierce, P.L.C.

(57) ABSTRACT

The invention relates to a device for locking and unlocking the roller shutter (12, 15) of a container (10) that can be inserted into a rack (11) and removed therefrom. The roller shutter (12, 15) is pulled open by a stationary pin engaging therewith during insertion of the container (10), it is pulled shut by the same engagement of the pin (14) when the container (10) is pulled out of the rack (11). In the closed position, the roller shutter (12, 15) shall be locked reliably and accurately. Two locking pins (21, 22) that can be actuated by cam tracks (35, 36) extending in longitudinal direction of the rack (11) and provided at the rack (11) serve for this purpose. The first locking pin (21) serves to lock the roller shutter (12, 15), the second locking pin (22) keeps the roller shutter (12, 15) in its exactly defined closed position during the locking by the first locking pin (21). As a result thereof, position errors of the roller shutter (12, 15) during locking and unlocking are prevented.

20 Claims, 4 Drawing Sheets

U.S. PATENT DOCUMENTS

| | | | | | |
|---|---|---|---|---|---|
| 4,638,746 | A | * | 1/1987 | Ishigure | 109/52 |
| 4,798,316 | A | * | 1/1989 | Martin et al. | 232/43.1 |
| 4,890,766 | A | * | 1/1990 | Martin et al. | 221/198 |
| 5,012,075 | A | | 4/1991 | Hutchison et al. | |
| 5,071,032 | A | * | 12/1991 | Thornton et al. | 221/154 |
| 6,059,090 | A | * | 5/2000 | Davis et al. | 194/350 |

FOREIGN PATENT DOCUMENTS

| | | | |
|---|---|---|---|
| EP | 0 418 098 | A1 | 3/1991 |
| EP | 15 50 625 | A2 | 7/2005 |
| GB | 2 016 421 | A | 9/1979 |
| GB | 2360510 | A | 9/2001 |

* cited by examiner

DEVICE FOR LOCKING AND UNLOCKING THE JALOUSIE OF A CONTAINER

CROSS-REFERENCE TO RELATED APPLICATIONS

This application is a National Stage of International Application No. PCT/EP2009/060613, filed Aug. 17, 2009. This application claims the benefit and priority of German application 10 2008 044 838.9 filed Aug. 28, 2008. The entire disclosures of the above applications are incorporated herein by reference.

This section provides background information related to the present disclosure which is not necessarily prior art.

BACKGROUND

1. Technical Field

The invention relates to a device for locking and unlocking the roller shutter of a container which can be inserted into a rack and removed therefrom, the closed roller shutter being unlocked at its longitudinal edge when the container is inserted into the rack and being pulled from its closed position into its open position by means of engagement with an engagement element arranged stationarily in the rack and, when the container is removed from the rack, the roller shutter being pulled from its open position into its closed position by means of this engagement and being locked.

2. Discussion

A device of this type is, for example, used in containers which are inserted or, respectively, removed from the rack of an automated teller machine or another apparatus for the input or withdrawal of valuables. Mostly, the containers have the form of a cassette that is closed at its front side by a roller shutter. In terms of the highest possible safety, the roller shutter is only automatically opened upon insertion of the cassette into a rack in that, during insertion, it is held by cams or pins that are arranged stationarily in the rack and is thus pulled into its open position. When the container is removed, the roller shutter is pulled into its closed position according to the same principle.

A device for opening and closing as well as for unlocking and locking the roller shutter of a cassette for valuables is described in document DE 690 04 906 T2. The roller shutter is automatically unlocked in order to be opened when the cassette is inserted into the rack, and it is pulled into the closed position and automatically locked when the cassette is removed from the rack. The automatic unlocking and locking is, however, not particularly described here, and mostly electromechanical devices that operate dependent on a contact actuation and are controlled by electronic circuits are used for this purpose.

In order to limit the expense combined with the highest-possible safety, a purely mechanical unlocking and locking of the roller shutter is aimed at. When using the principle of opening the roller shutter by means of engagement with an engagement element arranged stationarily in the rack, this element being formed as a cam or pin that engages with a corresponding opening in the roller shutter, then, as a result, the roller shutter can indeed be opened and again closed by the sliding movement of the cassette but a precise coordination of the functions of the cam engagement and the unlocking or, respectively, locking of the roller shutter is difficult as several mechanical elements have to be actuated independent of one another but in exact coordination with one another during the movement of the cassette. So that the stationary cam can reliably open the roller shutter during insertion of the cassette into the rack, the roller shutter has to be unlocked shortly before the engagement of the cam. As a result of mechanical tolerances and an imprecise movement of the cassette, the point of engagement of the cam with the roller shutter may be displaced. When the cassette is pulled out of the rack, the exact point at which the cam is to be released from engagement with the roller shutter cannot be defined precisely as the roller shutter might not yet be in the exact closed position in which it can be locked.

SUMMARY OF THE INVENTION

Therefore, it is the object of the invention to specify a device with which the roller shutter of a container that can be inserted into a rack and removed therefrom can be reliably locked and unlocked with purely mechanical means and, at the same time, mutual disturbances between the locking mechanism and the cam mechanism that opens and closes the roller shutter are avoided.

The invention solves this object for a device of the type mentioned at the beginning in that the container includes at least one longitudinal side two stationarily mounted locking elements that can be actuated by cam elements provided at the rack upon a sliding movement of the container, the first one of these locking elements locks and unlocks the roller shutter and the second one rests, when actuated, against a control element provided at the roller shutter and keeps the roller shutter in the closed position during locking and unlocking.

In a device according to the invention, the first locking element serves to lock the roller shutter at the container when the roller shutter has reached its closed position and to unlock the roller shutter when it is to leave its closed position. When actuated, the second locking element rests against the control element and keeps the roller shutter in the closed position until it is reliably unlocked or locked. Thus, the second locking element serves as an auxiliary element for the first locking element and prevents that displacements may occur during the locking and unlocking operation as a result of mechanical tolerances or an imprecise movement of the container, which displacements might disturb the mutual coordination of the function of the locking elements and the function of pulling the roller shutter open and shut. The point in time and the length of the actuation of the locking elements only depend on how the cam elements actuating the locking elements are positioned to each other at the rack and how long they are as their position determines the sequence of actuation during the insertion of the container into the rack and during its removal from the rack.

The inventive device may be arranged at only one longitudinal side of the container. Advantageously, however, it is provided at opposite longitudinal sides of the container, corresponding cam elements being arranged at the two opposite longitudinal sides of the rack. The roller shutter is then locked and unlocked at its two longitudinal sides, which increases the safety of its closure and prevents that it gets jammed in the course of reaching its closed position. The exact coordination of the function of the locking elements of both longitudinal sides of the container is guaranteed by the corresponding placement of the cam elements at the two longitudinal sides of the rack.

Advantageously, the cam elements are a first and a second cam track extending at the rack in sliding direction, and the length of the first cam track is dimensioned in accordance with the length of the unlocking state of the roller shutter during the insertion of the container, whereas the length of the second cam track is dimensioned in accordance with the length of the locking and unlocking operation.

When the container is inserted into the rack in this development of the invention, then the first locking element runs onto the first cam track and, as a result thereof, is actuated in order to be unlocked and remains in this position during the length of the unlocking state, i.e. during the inserted state of the container. During the insertion of the container, the second locking element runs onto the second cam track approximately simultaneously with the actuation of the first locking element, which second cam track only has to be dimensioned in accordance with the length of the locking and unlocking operation. The mutual positioning of the two cam tracks thus effects a very easy coordination of the unlocking and locking function as well as of the auxiliary function which is exerted by the second locking element when it keeps the roller shutter in its closed position during locking and unlocking.

This development of the invention in particular shows that an easy but very reliable and accurate coordination of the locking and unlocking of a roller shutter and its opening and closing operation becomes possible, for which purely mechanical elements are used so that expenses for electronic circuits and electro-mechanic switching elements can be saved.

BRIEF DESCRIPTION OF THE DRAWINGS

The drawings described herein are for illustrative purposes only of selected embodiments and not all possible implementations, and are not intended to limit the scope of the present disclosure.

In the following, the invention is explained in more detail with reference to the drawing.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
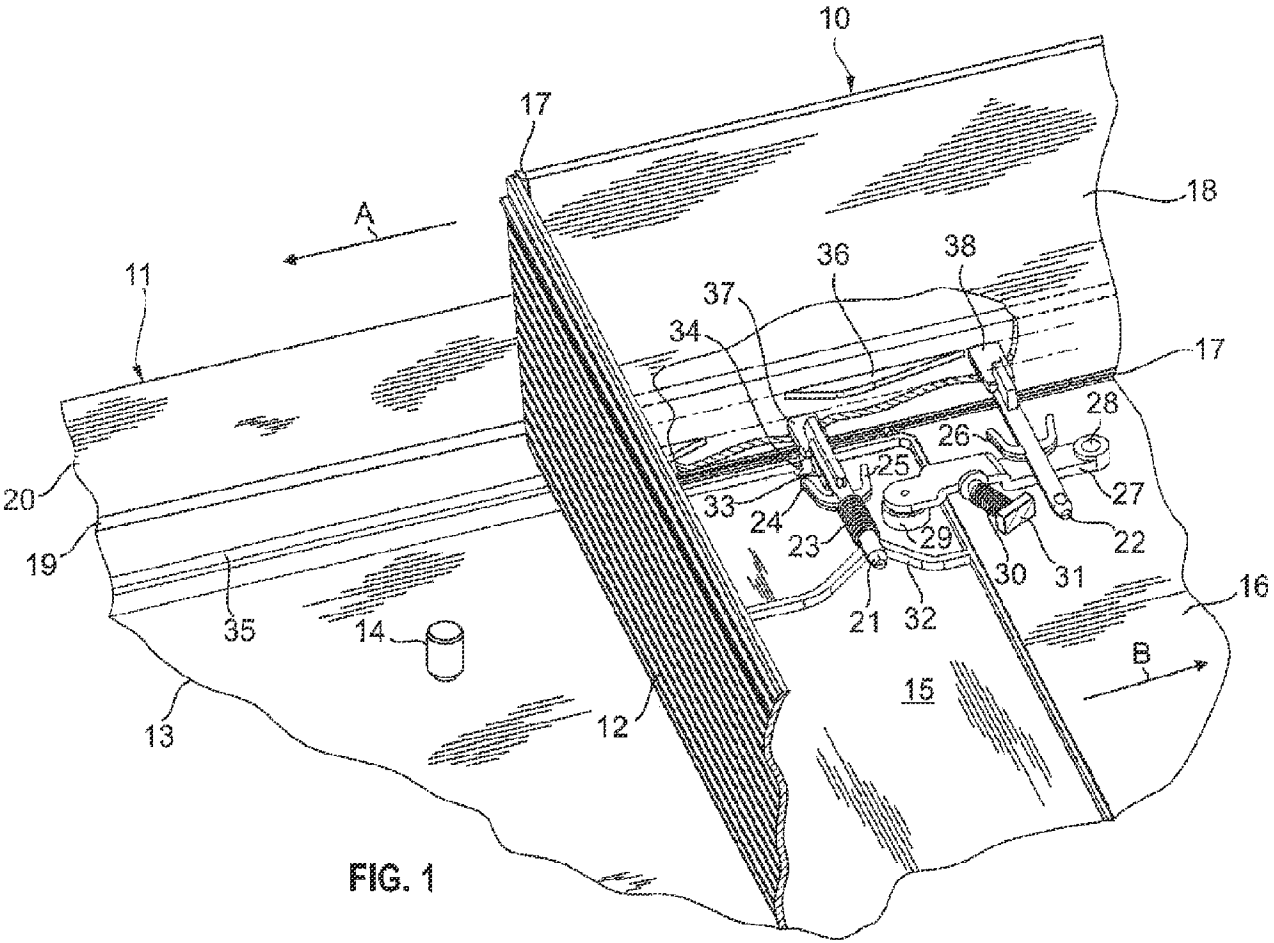
FIG. 1 shows a perspective partial illustration of a cassette which is inserted into a rack with closed roller shutter.
Figure 2:
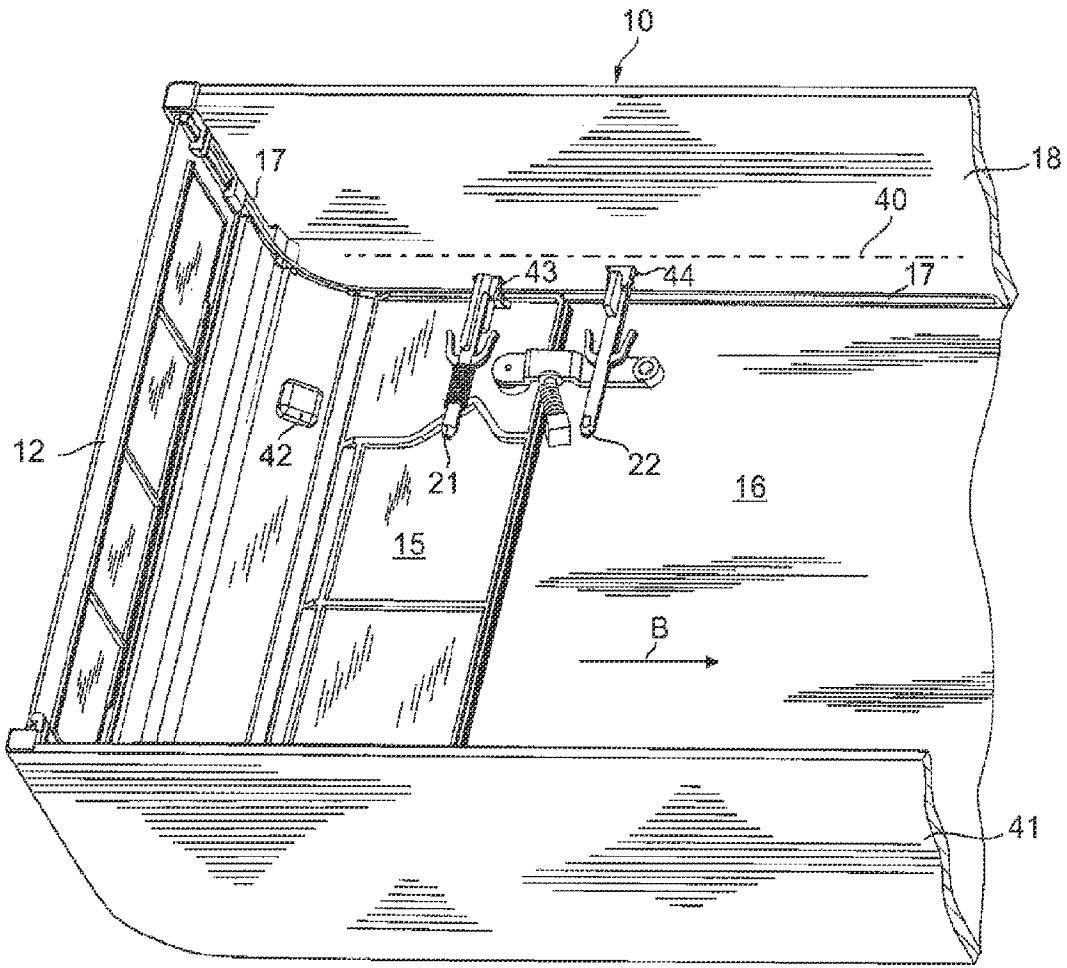
FIG. 2 shows a perspective partial illustration of the cassette according to FIG. 1 from another angle of view.

FIG. 1 shows a perspective partial illustration of a container for valuables in the form of a cassette 10 which is inserted into a rack 11 in the direction of arrow A. The cassette 10 is illustrated without a top cover to make its inner structure visible. At its front side, in the insertion direction A, the cassette 10 has a roller shutter 12 which, upon further insertion of the cassette 10 into the rack 11, is opened in that a pin 14 arranged stationarily at the bottom 13 of the rack 11 engages with a recess at the lower portion 15 of the roller shutter 12, which recess cannot be seen in FIG. 1, so that the roller shutter is pulled open by the insertion movement of the cassette 10 until it reaches an open position (FIG. 3) when the cassette 10 has reached its inserted rest position. Thus, for opening, the roller shutter 12 is pulled with its lower portion 15, which is guided parallel to the cassette bottom 16, to the right with respect to the illustration in FIG. 1 until its upper actual closing portion is likewise parallel to the cassette bottom 16. The pulling of the roller shutter 12, 15 relative to the cassette bottom 16 during opening is illustrated by the direction of arrow B. In its upper closing portion, the roller shutter 12 is made up of slats and guided in a guideway 17 in the side wall 18 of the cassette 10. The guideway 17 has a curved section as well as straight sections corresponding to the predetermined path of the roller shutter 12, as illustrated in FIG. 2.

During its sliding movement, the cassette 10 is guided in a guide groove 19 in the side wall 20 of the rack 11, for which a corresponding guide protrusion is provided on the outside of the side wall 18 of the cassette 10.

FIG. 1 shows the cassette 10 and the rack 11 in broken illustration. This entire arrangement can be similarly designed for the other side of the cassette 10 and the rack 11 not illustrated in FIG. 1, in particular a second stationary pin can be provided in addition to the pin 14, as a result whereof the roller shutter 12 is pulled open without getting jammed in its guideways 17 when the cassette 10 is inserted into the rack 11.

The roller shutter 12 of the cassette 10 shall, as already explained at the beginning, be automatically unlocked to be pulled open when the cassette 10 is inserted into the rack 11 and, after closing, be again automatically locked when the cassette 10 is removed from the rack 11. For this, a locking mechanism illustrated in FIG. 1 is provided whose interaction with the side wall 20 of the rack 10 is shown in that a portion of the side wall 18 of the cassette 10 has been broken away. The locking mechanism is located under a bottom plate of the cassette 10, which bottom plate is not illustrated in FIG. 1 and is parallel to the actual cassette bottom 16. The bottom plate can lie in a plane that is approximately at the level of the guide groove 19 in the side wall 20 of the rack 11. This bottom plate enables the undisturbed accommodation of objects in the cassette 10, in particular the stacking of banknotes, as this is known per se for cassettes of the type described herein.

In FIG. 1, two locking pins 21 and 22 are illustrated which are mounted movably in their longitudinal direction at the underside of the non-illustrated bottom plate. The locking pin 21 is resiliently biased by means of a pressure spring 23 toward the outside of the cassette, this pressure spring 23 bears against a non-illustrated guide element for the locking pin 21 and acts upon the locking pin 21 at two side arms 24 and 25. With one side arm 26, the locking pin 22 can act upon a control lever 27 that is pivotally mounted at a pivot point 28 at the non-illustrated bottom plate. At its free end, the control lever 27 supports a pressure roller 29 and is acted upon by a spring 30 toward the cassette outside. The spring 30 bears against a point of support 31 at the non-illustrated bottom plate of the cassette 10.

The pressure roller 29 of the control lever 27 can be pressed by the side arm 26 of the locking pin 22 against a control track 32 that is arranged in an inclined manner with respect to the opening direction B of the roller shutter 12 at the lower portion 15 of the roller shutter. This pressing is caused by a displacement of the locking pin 22 toward the inside of the cassette 10, by means of which displacement the side arm 26 of the locking pin 22 acts upon the control lever 27. The length of the control track is dimensioned such that it can be moved past the control lever 27 and the pressure roller 29 when the roller shutter 12 is pulled open and shut.

In FIG. 1, it can be seen that the two locking pins 21 and 22 are located at different heights above the cassette bottom 16. The locking pin 21 is located close above the lower portion 15 of the roller shutter 12 and, in its position shown in FIG. 1, it is guided with a lower longitudinal edge 33 in a U-shaped locking element 34 (FIG. 4) that is mounted on the roller shutter 12. The locking pin 22 is located higher than the locking pin 21 and above the control lever 27.

Corresponding to the different height levels of the two locking pins 21 and 22, two cam tracks 35 and 36 are provided at the side wall 20 of the rack 11, which cam tracks run parallel to the guide groove 19 in longitudinal direction and their mutual positioning in longitudinal direction of the cassette side wall 20 corresponds approximately to the mutual distance between the two locking pins 21 and 22. When the cassette 12 is inserted into the rack 11 in the insertion direction A, then the locking pins 21 and 22 each run with a front flat driver 37 and 38, respectively, onto the respective associated cam track 35 and 36, respectively, and, as a result thereof, are pushed toward the interior of the cassette 10. In doing so, the lower longitudinal edge 33 of the locking pin 21 is moved out of the locking element 34 to unlock the roller shutter 12. As shown in FIG. 1, the locking pins 21 and 22 run onto the cam tracks 35 and 36 when the cassette 10 has been inserted in insertion direction A so far that the stationary pin 14 on the rack bottom 13 can engage with the roller shutter 12.

The second locking pin 22 is an auxiliary element for unlocking the roller shutter 12 and guarantees a high preciseness of the unlocking in coordination with the position of the pin 14 at the roller shutter 12. The roller shutter 12 shall be unlocked at that point in time at which the pin 14 on the rack bottom 13 engages therewith. At this point in time, the roller shutter 12 however shall still be exactly in its closed position. In order to guarantee this, the locking pin 22, as an auxiliary element for the unlocking, is displaced toward the interior of the cassette 10 by running onto its cam track 36 and, as a result thereof, it acts upon the control lever 27 against the force of the spring 30. As a result thereof, the pressure roller 29 is pressed against the control track 32 that extends in an inclined manner to the opening direction B of the lower portion 15 of the roller shutter 12, and thus this lower portion is kept in the closed position, even if the locking pin 21 has already unlocked the roller shutter 12. Only when the opening movement of the roller shutter 12 starts by means of the engagement of the stationary pin 14 at the rack bottom 13, the pressure roller 29 can roll along the control track 32, and when, upon a further insertion movement of the cassette 10, the locking pin 22 runs off its cam track 36 and is again pressed outward by the force of the spring 30 via the control lever 27, the roller shutter 12 can finally be pulled open in an unimpeded manner.

A mechanism of the type described above can also be provided at the second side of the cassette 10 that is not illustrated in FIG. 1. This enables a symmetric unlocking of the roller shutter 12 at two guiding sides.

In FIG. 2, the cassette 10 is shown without a top cover and with closed roller shutter 12 from another angle of view without the rack 11 (FIG. 1) in broken illustration. At the side wall 18, a dash-dotted line 40 is shown which shall indicate at which height above the locking mechanism a non-illustrated bottom plate covering the locking mechanism may approximately be located. A second side wall 41 of the cassette 10 in which the roller shutter 12 and its lower portion 15, respectively, are likewise guided is also illustrated. The guide groove 17 of the roller shutter 12, 15 in the side wall 18 is curved at the junction between the front side of the cassette 10 and the cassette bottom 16. A corresponding guidance is also provided on the inside of the side wall 41, which however is not visible in FIG. 2.

In its curved portion, the roller shutter 12 has a recess 42 directed from the outside to the inside, which, in FIG. 2, forms a protrusion on the inside of the roller shutter 12. This recess 42 serves for engagement with the stationary pin 14 at the rack bottom 13 (FIG. 1), as a result whereof the roller shutter 12, given a sliding movement of the cassette 10, is pulled open to the right with respect to the illustration in FIG. 2 in opening direction B. In doing so, it is guided in the guide groove 17 in the side wall 18 and in a like guide groove in the side wall 41.

In FIG. 2, it can further be seen that the locking pins 21 and 22 project outwardly through windows 43 and 44 of the side wall 18 of the cassette 10, where they can run on the cam tracks 35 and 36 (FIG. 1).

Figure 3:
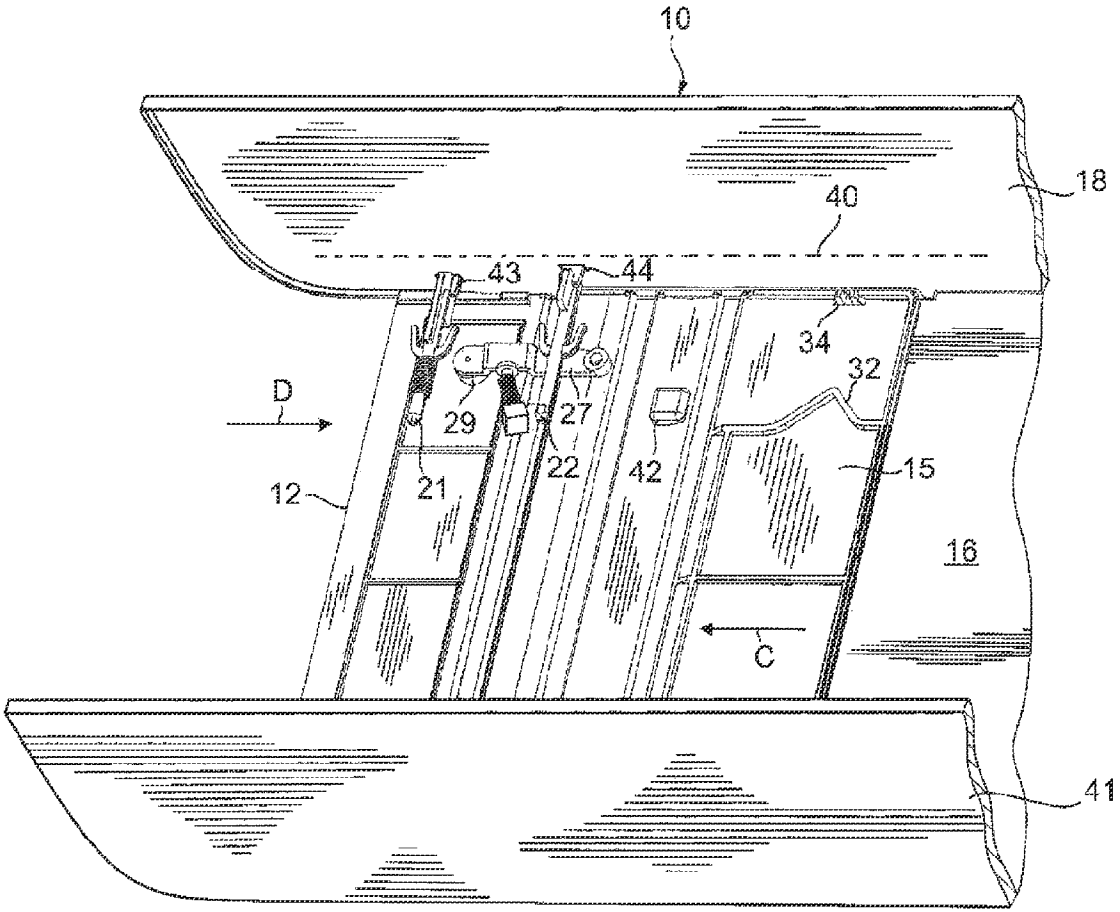
FIG. 3 shows a perspective partial illustration of the cassette shown in FIGS. 1 and 2 with open roller shutter.

FIG. 3 is an illustration similar to FIG. 2, the roller shutter 12, however, being shown in its pulled-open open position. The lower portion 15 of the roller shutter 12 is located, with the locking element 34 mounted thereon, in the outermost right extreme position into which the roller shutter 12 has been pulled by the engagement of the pin 14 (FIG. 1) with the recess 42. In this state of the roller shutter 12, the cassette 10 is completely inserted into the rack 11 (FIG. 1), and the roller shutter 12 is completely pulled open. The pin 14 (FIG. 1) remains engaged with the recess 42 of the roller shutter 12.

When the cassette 10 is pulled out of the non-illustrated rack 11 (FIG. 1) in the direction of arrow D shown in FIG. 3, then by way of the continued engagement of the stationary pin 14 (FIG. 1) with the recess 42 the roller shutter 12 is pulled shut to the left in the closing direction C shown in FIG. 3 so that it finally reaches its closed position which is illustrated in FIGS. 1 and 2. The locking element 34 moves toward the first locking pin 21 until it is located below the pin in the closed position of the roller shutter 12. At the same time, the driver 37 of the locking pin 21 moves to the right on the cam track 35 (FIG. 1) until it run offs the cam track 35 at its right end and can engage with its lower longitudinal edge 33 into the locking element 34.

The control track 32 moves with the lower portion 15 of the roller shutter 12 past the pressure roller 29, and the latter is again pressed against the control track 32 when the driver 38 of the second locking pin 22 runs onto its cam track 36 from the left (FIG. 1) so that, by the acting of the pressure roller 29 upon the control track 32, the roller shutter 12, in the case of a possible inaccurate guidance or an inaccurate engagement of the pin 14 (FIG. 1) with the recess 42, is again pressed into its exact closed position and is kept thereat until the first locking pin 21 is engaged with the locking element 34. Then, the second locking pin 22 can likewise run off its cam track 36 to the right (FIG. 1) so that it is pressed outwardly via its side arm 26 by the force of the spring 30 at the control lever 27.

Figure 4:
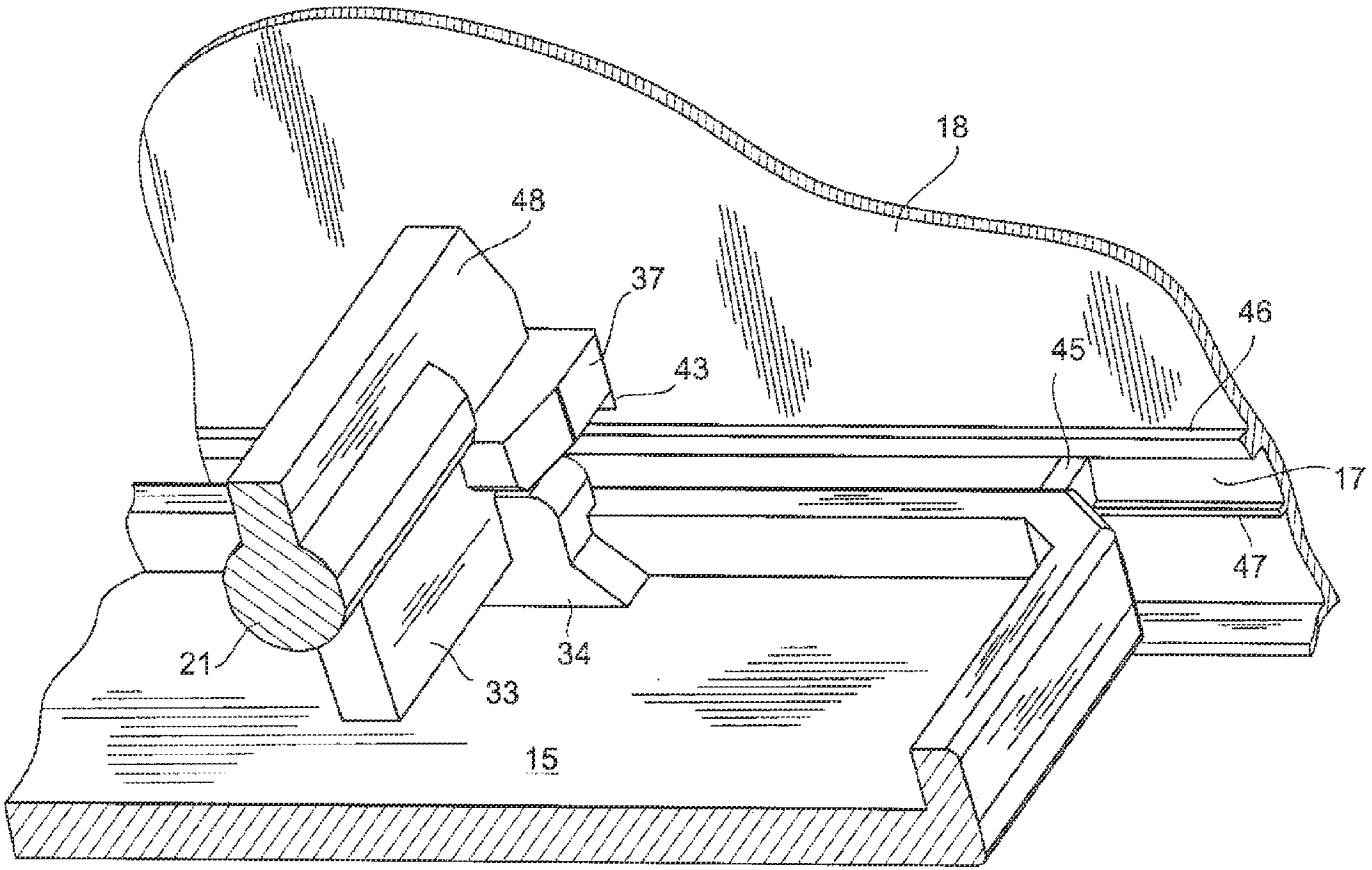
FIG. 4 shows a perspective partial illustration of a detail of FIGS. 1 to 3.

FIG. 4 shows a detail of FIGS. 1 to 3 in perspective illustration. A part of the side wall 18 of the cassette 10 is illustrated in which the window 43 for the front driver 37 of the first locking pin 21 is located. With its lower longitudinal edge 33, the locking pin is engaged with the locking element 34 that is located at the lower portion 15 of the roller shutter 12. It can also be seen that the locking pin 21 has an upper longitudinal edge 48 with which it abuts the side wall 18 of the cassette 10 when it is engaged with the lower longitudinal edge 33 into the locking element 34.

FIG. 4 also shows a part of the guide groove 17 for the roller shutter 12 and for its lower portion 15, respectively. The guide groove 17 is formed by two longitudinal protrusions 46 and 47 at the side wall 18 of the cassette 10, and a guiding block 45 of the lower portion 15 is guided therein.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A device for locking and unlocking a roller shutter of a container that can be inserted into a rack and removed therefrom, the closed roller shutter being unlocked when the container is inserted into the rack and being pulled from its closed position into its open position by means of engagement with an engagement element arranged stationarily in the rack and, when the container is removed from the rack, the roller shutter being pulled from its open position into its closed position by means of this engagement and being locked, comprising wherein the container includes at least one longitudinal sidewall, two stationarily mounted locking elements that are actuated by cam elements provided at the rack upon a sliding movement of the container, the first one of these locking elements locks and unlocks the roller shutter and the second one rests, when actuated, against a control element provided at the roller shutter and keeps the roller shutter in the closed position during locking and unlocking.

2. The device according to claim 1, wherein the at least one longitudinal sidewall of the container comprises a first and second sidewall, wherein the two stationarily mounted locking elements are first locking elements at the first sidewall of the container and the cam elements are first cam elements at a first sidewall of the rack, the device further includes second locking elements at the second sidewall of the container that is opposite to the first sidewall of the container, and second cam elements at a second sidewall of the rack that is opposite to the first sidewall of the rack, the first locking elements are substantially similar to the second locking elements and the first cam elements are substantially similar to the second cam elements.

3. The device according to claim 1, wherein the cam elements are a first and second cam track extending in sliding direction at the rack and in that the length of the first cam track is dimensioned in accordance with the length of the unlocking state of the roller shutter during the insertion state of the container and the length of the second cam track is dimensioned in accordance with the length of the locking and unlocking operation.

4. The device according to claim 1, wherein the locking elements are locking pins slidably guided at the container transversely to its sliding direction and in that the first locking pin is resiliently biased toward the locking position.

5. The device according to claim 4, wherein in the locking position the first locking pin sits with a longitudinal edge formed thereon in a U-shaped locking element provided at the longitudinal edge of the roller shutter, the longitudinal edge being pushed out of this U-shaped locking element in the unlocking position by the running of the first locking pin onto a first cam track.

6. The device according to claim 4, wherein the second locking pin, when actuated upon running onto a second cam track, is coupled with a control element provided on the inside of the roller shutter such that the roller shutter is kept in its closed position during the actuation state of the second locking pin.

7. The device according to claim 6, wherein the second locking pin is coupled to the control element via a control lever pivotally mounted on the container, which control lever is resiliently biased into a rest position when the second locking pin is in its rest position.

8. The device according to claim 7, wherein the control element is a control track extending in an inclined manner to the pulling direction of the roller shutter along the inside of a portion of the roller shutter lying parallel to the container bottom in the closed state of the roller shutter, a roller provided at the free end of the control lever resting against the control track during locking and unlocking.

9. The device according to claim 8, wherein the inclined course of the control track has a length that, in the rest position of the control lever, allows the pulling of the roller shutter into its open position and into its closed position past the control lever and the roller.

10. A cassette configured for insertion into, and removal from, a rack, the cassette comprising:

a first sidewall and a second sidewall;

a roller shutter moveable from a closed position to an open position when the cassette is slidably inserted into the rack through cooperation between the roller shutter and a stationary engagement element of the rack, the roller shutter moveable to a closed position when the cassette is slidably removed from within the rack through cooperation between the roller shutter and the stationary engagement element;

a control element at an inner surface of the roller shutter;

a first locking element configured to extend through the first sidewall and slidably moveable from a locked position to an unlocked position to unlock the roller shutter upon contact with a first cam element of the rack; and a second locking element configured to extend through the first sidewall and slidably moveable into engagement with the control element upon contact with a second cam element of the rack to maintain the roller shutter closed during unlocking and locking of the roller shutter by the first locking element.

11. The cassette of claim 10, wherein the first locking element includes a first locking pin and the second locking element includes a second locking pin.

12. The cassette of claim 10, further comprising a locking member mounted to the inner surface of the roller shutter, the first locking element coupled to the locking member when in the locked position.

13. The cassette of claim 10, wherein the roller shutter defines a recess configured to cooperate with the stationary engagement element of the rack.

14. The cassette of claim 10, wherein the second locking element includes a control lever with a pressure roller at a distal end thereof, the pressure roller contacts the control element to maintain the roller shutter closed when the second locking element is in engagement with the second cam element.

15. The cassette of claim 10, wherein the first and the second locking elements are slidably moveable in a plane that extends generally perpendicular to the first sidewall.

16. A cassette configured for insertion into, and removal from, a rack, the cassette comprising:

a first sidewall and a second sidewall, each of which extend generally parallel to one another;

a roller shutter extending between the first sidewall and the second sidewall, the roller shutter movable between a closed position and an open position;

a recess defined in the roller shutter, the recess configured to cooperate with a rack pin of the rack to slide the roller shutter open when the cassette is slid into the rack and to slide the roller shutter closed when the cassette is slid out of the rack;

a locking member at an inner surface of the roller shutter that moves with the roller shutter between the closed position and the open position;

a first locking element mounted to the cassette and slidably movable in a direction generally perpendicular to the first and second sidewalls, the first locking element extends through the first sidewall and is positioned to contact a first cam of the rack, the first locking element is slidably moved into the cassette upon contacting the first cam, the first locking element is configured to couple with the locking member of the roller shutter to lock the roller shutter in a closed position, and configured to decouple from the locking member to unlock the roller shutter and permit movement of the roller shutter to an open position; and a second locking element mounted to the cassette and slidably moveable in a direction generally perpendicular to the first and second sidewalls, the second locking element extends through the first sidewall and is positioned to contact a second cam of the rack, the second locking element is slidably moved into the cassette upon contacting the second cam to move a control lever into engagement with the control element and maintain the roller shutter in the closed position during locking and unlocking of the roller shutter.

17. The cassette of claim 16, wherein the first locking element is a first locking pin and the second locking element is a second locking pin.

18. The cassette of claim 16, wherein the control lever includes a pressure roller at an end thereof, the pressure roller is configured to contact the control element in response to contact between the second locking element and the second cam.

19. The cassette of claim 16, wherein the control element protrudes from the inner surface of the roller shutter.

20. The cassette of claim 16, wherein the first locking element is biased with a spring to extend out from within the cassette.

* * * * *